US012098110B2

(12) United States Patent
Doll et al.

(10) Patent No.: US 12,098,110 B2
(45) Date of Patent: Sep. 24, 2024

(54) SOLID ROCKET MOTOR HAVING HYDORXYL-TERMINATED BINDER WEIGHT DIOL

(71) Applicant: Aerojet Rocketyne, Inc., Sacramento, CA (US)

(72) Inventors: Daniel Doll, Orange, VA (US); Scott K. Dawley, Culpeper, VA (US)

(73) Assignee: AEROJET ROCKETDYNE, INC., Sacramento, CA (US)

( * ) Notice: Subject to any disclaimer, the term of this patent is extended or adjusted under 35 U.S.C. 154(b) by 1264 days.

(21) Appl. No.: 15/762,761

(22) PCT Filed: Nov. 15, 2016

(86) PCT No.: PCT/US2016/061972

§ 371 (c)(1),
(2) Date: Mar. 23, 2018

(87) PCT Pub. No.: WO2017/131841

PCT Pub. Date: Aug. 3, 2017

(65) Prior Publication Data

US 2019/0077725 A1 Mar. 14, 2019

Related U.S. Application Data

(60) Provisional application No. 62/257,093, filed on Nov. 18, 2015.

(51) Int. Cl.
*C06B 45/10* (2006.01)
*C06B 31/08* (2006.01)

(52) U.S. Cl.
CPC ..... *C06B 45/10* (2013.01); *C06B 31/08* (2013.01)

(58) Field of Classification Search
None
See application file for complete search history.

(56) References Cited

U.S. PATENT DOCUMENTS

| | | | | |
|---|---|---|---|---|
| 4,181,545 | A | 1/1980 | Anderson | |
| 4,210,474 | A | 7/1980 | Ramohalli | |
| 4,632,715 | A | 12/1986 | Curtis | |
| 5,619,011 | A | 4/1997 | Dean | |
| 6,384,130 | B1 * | 5/2002 | Pantone | C08G 18/2825 524/198 |
| 7,824,511 | B1 * | 11/2010 | Baker | C06B 21/0025 149/19.92 |

FOREIGN PATENT DOCUMENTS

| | | |
|---|---|---|
| JP | S62-256784 | 11/1987 |
| WO | 0021908 | 4/2000 |

OTHER PUBLICATIONS

International Search Report and Written Opinion for PCT Application No. PCT/US2016/061972, mailed Aug. 8, 2017.
The International Preliminary Report on Patentability for PCT Application No. PCT/US2016/061972, mailed May 31, 2018.

* cited by examiner

*Primary Examiner* — Aileen B Felton
(74) *Attorney, Agent, or Firm* — Carlson, Gaskey & Olds, P.C.

(57) ABSTRACT

A solid rocket propellant includes a hydroxyl-terminated polybudadiene (HTPB) binder system having a high molecular weight diol that is greater than thirty carbon atoms ($>C_{30}$) and less than fifty carbon atoms ($<C_{50}$) and excluding dimeryl diisocyanate (DDI).

16 Claims, 1 Drawing Sheet

SOLID ROCKET MOTOR HAVING HYDORXYL-TERMINATED BINDER WEIGHT DIOL

CROSS-REFERENCE TO RELATED APPLICATIONS

The present disclosure claims priority to U.S. Provisional Patent Application No. 62/257,093, filed Nov. 18, 2015.

BACKGROUND

Solid rocket motors typically include a cast solid propellant. Solid propellant may include oxidizer, fuel, or both, held together with a binder. Ignition of the solid propellant generates high pressure gas, which is expelled through a nozzle to generate thrust.

SUMMARY

A solid rocket propellant according to an example of the present disclosure includes a hydroxyl-terminated polybudadiene (HTPB) binder system that has a high molecular weight diol that is greater than thirty carbon atoms ($>C_{30}$) and less than fifty carbon atoms ($<C_{50}$) and excludes dimeryl diisocyanate (DDI).

In a further embodiment of any of the foregoing embodiments, the high molecular weight diol is a dimer diol (DD).

A further embodiment of any of the foregoing embodiment includes, a perchlorate oxidizer and a fuel.

In a further embodiment of any of the foregoing embodiments, the perchlorate oxidizer includes at least one of ammonium perchlorate, sodium perchlorate, or potassium perchlorate, and the fuel includes at least one of aluminum, magnesium, or boron.

In a further embodiment of any of the foregoing embodiments, the perchlorate oxidizer is ammonium perchlorate, and the fuel is aluminum.

In a further embodiment of any of the foregoing embodiments, the perchlorate oxidizer, the fuel, and the HTPB binder system have a total combined weight, and the high molecular weight diol is 0.1% to 10% of the total combined weight.

In a further embodiment of any of the foregoing embodiments, the high molecular weight diol is 1% to 5% of the total combined weight.

In a further embodiment of any of the foregoing embodiments, the HTPB binder system includes a diiso or polyisocyanate.

In a further embodiment of any of the foregoing embodiments, the diisocyanate is selected from the group consisting of isophorone diisocyanate, hexamethylene diisocyanate, aromatic diiso- or polyisocyanate, and aliphatic diiso- and polyisocyanate.

A further embodiment of any of the foregoing embodiment includes, a perchlorate oxidizer and a fuel. The perchlorate oxidizer, the fuel, and the HTPB binder system have a total combined weight, and the high molecular weight diol is 0.1% to 10% of the total combined weight, and the HTPB binder system includes a diisocyanate selected from the group consisting of isophorone diisocyanate, hexamethylene diisocyanate, aromatic diiso- or polyisocyanate, and aliphatic diiso- or polyisocyanate.

A solid rocket propellant according to an example of the present disclosure includes a perchlorate oxidizer, a fuel, and a hydroxyl-terminated binder system having a dimer diol (DD).

In a further embodiment of any of the foregoing embodiments, the perchlorate oxidizer, the fuel, and the hydroxyl-terminated binder system have a total combined weight, and the DD is 0.1% to 10% of the total combined weight.

In a further embodiment of any of the foregoing embodiments, the perchlorate oxidizer includes at least one of ammonium perchlorate, sodium perchlorate, or potassium perchlorate.

In a further embodiment of any of the foregoing embodiments, the fuel includes at least one of aluminum, magnesium, or boron.

In a further embodiment of any of the foregoing embodiments, the perchlorate oxidizer includes ammonium perchlorate.

In a further embodiment of any of the foregoing embodiments, the fuel includes aluminum.

In a further embodiment of any of the foregoing embodiments, the DD has greater than thirty carbon atoms ($>C_{30}$) and less than fifty carbon atoms ($<C_{50}$).

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
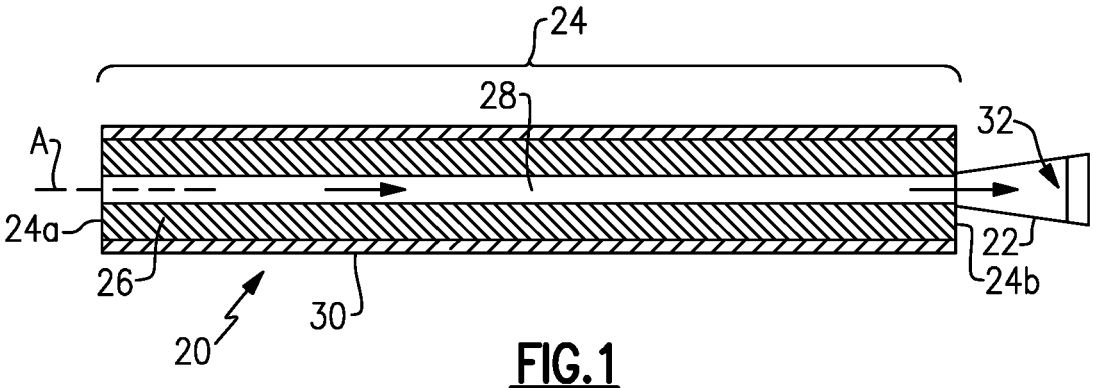
FIG. 1 illustrates an example solid rocket motor.
Figure 2:
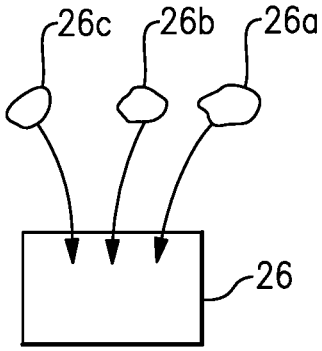
FIG. 2 illustrates an example solid propellant.

FIG. 1 illustrates a cross-section of selected portions of an example solid rocket motor 20, which is also an example of an energetic device. The solid rocket motor 20 generally includes a nozzle 22 and a solid propellant section 24. The solid propellant section 24 includes a forward end 24*a* and an aft end 24*b*. The nozzle 22 is attached at the aft end 24*b*. As will be appreciated, the solid rocket motor 20 may include additional components related to the operation thereof, which are generally known and thus not described herein.

The solid propellant section 24 includes a solid propellant 26. In this example, the solid propellant 26 defines an elongated bore 28. The geometry of the bore 28 may be cylindrical and may have radial fin slots or other features. Alternatively, the solid propellant 26 may not have a bore. The solid propellant 26 is disposed within a motor case 30 about a central axis A.

Upon ignition the solid propellant 26 reacts to produce high temperature and high pressure gas (combustion gas). The combustion gas flows down the bore 28 and discharges through the nozzle 22 to produce thrust.

The motor 20 may be fabricated by injecting or casting the solid propellant 26 in the case 30. For instance, the constituents of the solid propellant 26 are mixed together and then injected or poured into the case or an appropriate mold. The mixture then cures, thus producing the final solid propellant 26 in the desired geometry.

The solid propellant 26 at least includes a polymer-based binder system and an oxidizer. Depending on the requirements of a particular design, the solid propellant 26 may also include a solid fuel. The constituents of the binder system of the solid propellant 26 include a base pre-polymer and a curative. The curative reacts with the base pre-polymer to form crosslinks, which serve to make the binder elastic, reduce vaporization, and reduce burn rate, for example. FIG.

2 schematically illustrates the various constituents that are mixed together to form the solid propellant 26. In this example, the solid propellant 26 includes a fuel 26*a*, a binder system 26*b*, and a perchlorate oxidizer 26*c*. Optionally, additives, modifiers, and the like may additionally be used.

The binder system 26*b* is a hydroxyl-terminated binder system. One example hydroxyl-terminated binder system is a hydroxyl-terminated polybutadiene system in which the pre-polymer is hydroxyl-terminated polybutadiene (HTPB). Such systems can include a curative of dimer diisocyanate (DDI), which possesses advantages for burning rate suppression. However, the binder system 26*b* includes a replacement for DDI, a high molecular weight diol (e.g. a dimer diol (DD)), and a commercially available diisocyanate other than DDI. Other examples of DD include high molecular weight diols that have greater than thirty carbon atoms ($>C_{30}$) and less than fifty carbon atoms ($<C_{50}$). Examples of diols of $>C_{30}$ and $<C_{50}$ include, but are not limited to, the Unilin series of diols (UNILIN® 350, UNILIN® 425, UNILIN® 550 and UNILIN® 700 with $M_n$ approximately equal to 375, 460, 550 and 700 g/mol, respectively) by Baker Hughes and Pripol 2033 (CAS 147853-32-5) by Croda Coatings. In one example, the DD is classified under CAS Registry Number 147853-32-5. The chemical structure of HTPB and further examples of dimer diols and the corresponding chemical structures are shown below.

Hydroxy-Terminated Polybutadiene (HTPB)

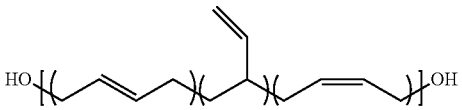

Dimer Diol (Acyclic 1)
9,10-Dinonyl-1,18-octadecanediol

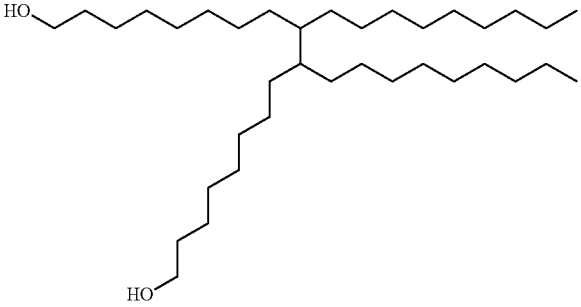

Dimer Diol (Acyclic 2) 3,4-dihexyl-9,10-octadiol
Decalin

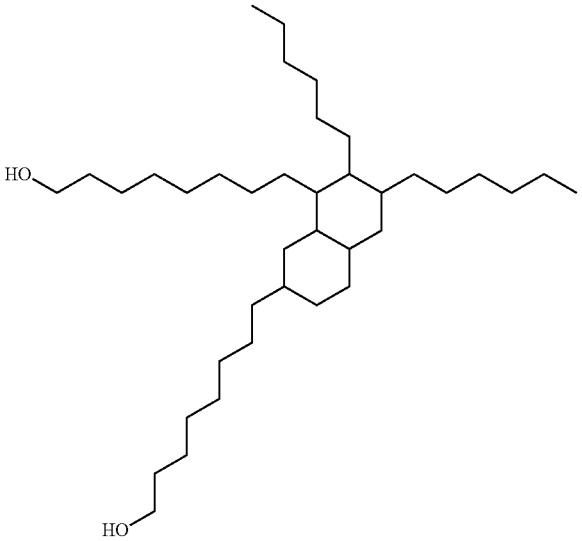

Dimer Diol (Aromatic)
1-Octyl-2-benzyl-5,6-octadiol

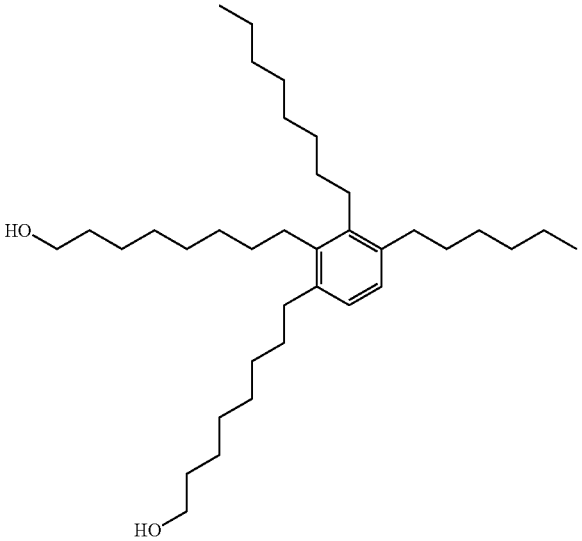

Dimer Diol (Monocyclic)
1-Octyl-2-cyclohexyl-5,6-octadiol

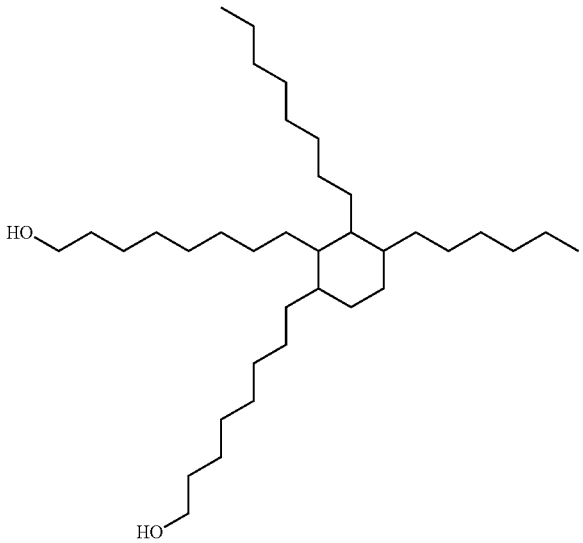

The binder system 26*b* most typically further includes a diisocyanate, excluding dimeryl diisocyanate. Example diisocyanates may include, but are not limited to, isophorone diisocyanate (IPDI), hexamethylene diisocyanate (HMDI), aromatic diiso- or polyisocyanates, and aliphatic diiso- or polyisocyanates (e.g., DESMODUR® N-3200). The diisocyanate reacts with hydroxyl groups of the high molecular weight diol, such as the Acyclic 1, Acyclic 2, Aromatic, or Monocyclic dimer diols above, and of the HTPB to form cross-links in the final HTPB. In some examples, the cross-links formed from the high molecular weight diol and diisocyanate may be a chemically similar to those formed by using dimeryl diisocyanate (DDI) as the curative. Thus, similar binder properties can be obtained with high molecular weight diol in comparison to DDI, but without using DDI as one of the constituents that are mixed together to form the solid propellant. An example chemical structure of the cured binder is shown below, where "R" is DD, such as the Acyclic 1, Acyclic 2, Aromatic, or Monocyclic dimer diols above.

Cured Binder (HTPB+IPDI+DD)

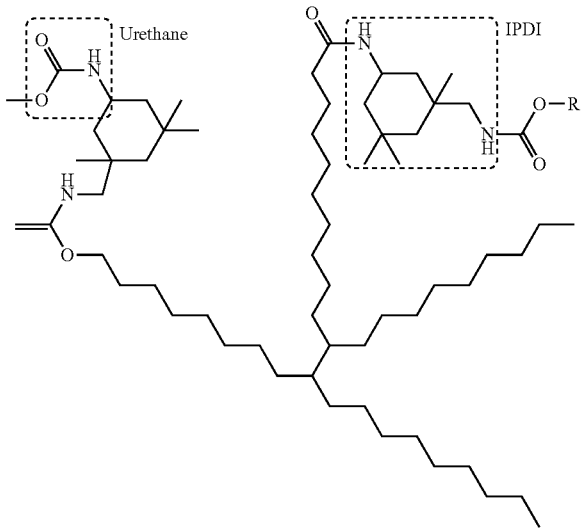

In further examples, the fuel 26*a* includes at least one of aluminum, magnesium, or boron, the binder system 26*b* is a hydroxyl-terminated polybutadiene binder system with high molecular weight diol and curative, and the perchlorate oxidizer 26*c* includes at least one of ammonium perchlorate, sodium perchlorate, or potassium perchlorate. In an additional example, the fuel 26*a*, the binder system 26*b*, and the perchlorate oxidizer have a total combined weight, and the high molecular weight diol is 0.5% to 10% of the total combined weight. In one further example, the high molecular weight diol is 1% to 5% of the total combined weight.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A solid rocket propellant comprising:

a hydroxyl-terminated polybudadiene (HTPB) binder system having a high molecular weight diol that is selected from the group consisting of 9,10-dinonyl-1,18-octadecanediol, 3,4-dihexyl-9,10-octadiol decalin, 1-octyl-2-benzyl-5,6-octadiol, 1-octyl-2-cyclohexyl-5,6-octadiol, and combinations thereof and excluding dimeryl diisocyanate (DDI).

2. The solid rocket propellant as recited in claim 1, further comprising a perchlorate oxidizer and a fuel.

3. The solid rocket propellant as recited in claim 2, wherein the perchlorate oxidizer includes at least one of ammonium perchlorate, sodium perchlorate, or potassium perchlorate, and the fuel includes at least one of aluminum, magnesium, or boron.

4. The solid rocket propellant as recited in claim 3, wherein the perchlorate oxidizer is ammonium perchlorate, and the fuel is aluminum.

5. The solid rocket propellant as recited in claim 2, wherein the perchlorate oxidizer, the fuel, and the HTPB binder system have a total combined weight, and the high molecular weight diol is 0.1% to 10% of the total combined weight.

6. The solid rocket propellant as recited in claim 5, wherein the high molecular weight diol is 1% to 5% of the total combined weight.

7. The solid rocket propellant as recited in claim 1, wherein the HTPB binder system includes a diiso or polyisocyanate.

8. The solid rocket propellant as recited in claim 7, wherein the diisocyanate is selected from the group consisting of isophorone diisocyanate, hexamethylene diisocyanate, aromatic diiso- or polyisocyanate, and aliphatic diiso- and polyisocyanate.

9. A solid rocket propellant comprising:

a perchlorate oxidizer;

a fuel; and a hydroxyl-terminated binder system having a dimer diol (DD) selected from the group consisting of 9,10-dinonyl-1,18-octadecanediol, 3,4-dihexyl-9,10-octadiol decalin, 1-octyl-2-benzyl-5,6-octadiol, 1-octyl-2-cyclohexyl-5,6-octadiol, and combinations thereof.

10. The solid rocket propellant as recited in claim 9, wherein the perchlorate oxidizer, the fuel, and the hydroxyl-terminated binder system have a total combined weight, and the DD is 0.1% to 10% of the total combined weight.

11. The solid rocket propellant as recited in claim 10, wherein the perchlorate oxidizer includes at least one of ammonium perchlorate, sodium perchlorate, or potassium perchlorate.

12. The solid rocket propellant as recited in claim 11, wherein the fuel includes at least one of aluminum, magnesium, or boron.

13. The solid rocket propellant as recited in claim 11, wherein the perchlorate oxidizer includes ammonium perchlorate.

14. The solid rocket propellant as recited in claim 13, wherein the fuel includes aluminum.

15. The solid rocket propellant as recited in claim 13, wherein the DD has a number average molecular weight ($M_n$) of 375 to 700 g/mol.

16. The solid rocket propellant as recited in claim 13, wherein the binder system includes isophorone diisocyanate.

* * * * *